US009837177B1

(12) United States Patent
Roper et al.

(10) Patent No.: US 9,837,177 B1
(45) Date of Patent: Dec. 5, 2017

(54) VAPOR CELLS WITH A BIDIRECTIONAL SOLID-STATE CHARGE-DEPLETION CAPACITOR FOR MOBILE IONS

(71) Applicant: HRL Laboratories, LLC, Malibu, CA (US)

(72) Inventors: Christopher S. Roper, Oak Park, CA (US); Matthew T. Rakher, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 15/271,353

(22) Filed: Sep. 21, 2016

Related U.S. Application Data

(60) Provisional application No. 62/237,004, filed on Oct. 5, 2015.

(51) Int. Cl.
*G21K 1/00* (2006.01)
*G21K 1/093* (2006.01)

(52) U.S. Cl.
CPC ..... *G21K 1/006* (2013.01); *G21K 1/093* (2013.01)

(58) Field of Classification Search
USPC ..... 250/432 R
See application file for complete search history.

(56) References Cited

U.S. PATENT DOCUMENTS 4,495,478 A * 1/1985 Kwon ..... H01P 7/06 324/305
8,009,520 B2 * 8/2011 Jau ..... G04F 5/14 324/301
9,064,942 B2 * 6/2015 Bangsaruntip ..... H01L 21/77
9,077,354 B2 * 7/2015 Strabley ..... H03L 7/26
9,685,483 B2 * 6/2017 Nazarian ..... H01L 27/2436

* cited by examiner

*Primary Examiner* — Phillip A Johnston
(74) *Attorney, Agent, or Firm* — O'Connor & Company

(57) ABSTRACT

The present invention provides a vapor-cell system comprising: a vapor-cell region configured for vapor-cell optical paths; a first electrode disposed in contact with the vapor-cell region; a second electrode electrically isolated from the first electrode; and an ion conductor interposed between the first electrode and the second electrode. The first electrode, the ion conductor, and the second electrode collectively form a bidirectional solid-state electrochemical charge-depletion capacitor. The ion conductor is ionically conductive for mobile ions, such as $Rb^+$, $Cs^+$, $Na^+$, $K^+$, or $Sr^{2+}$. The first electrode is permeable to the mobile ions and/or neutral atoms formed from the mobile ions. The system can be electrically controlled to quickly pump mobile ions into or out of the vapor-cell region. The system may further contain an atom chip, and the vapor-cell optical paths may be configured to trap a population of cold atoms. Methods of operating these vapor-cell systems are also disclosed.

24 Claims, 9 Drawing Sheets

VAPOR CELLS WITH A BIDIRECTIONAL SOLID-STATE CHARGE-DEPLETION CAPACITOR FOR MOBILE IONS

PRIORITY DATA

This patent application is a non-provisional application with priority to U.S. Provisional Patent App. No. 62/237,004, filed Oct. 5, 2015, which is hereby incorporated by reference herein.

STATEMENT REGARDING FEDERALLY SPONSORED RESEARCH OR DEVELOPMENT

This invention was made with Government support under Contract No. N66001-15-C-4027. The Government has certain rights in this invention.

FIELD OF THE INVENTION

The present invention generally relates to alkali and alkaline earth vapor cells, systems containing vapor cells, and methods of using vapor cells.

BACKGROUND OF THE INVENTION

Alkali vapor-cells have been used extensively since the 1960s in the study of atom-light interactions. Vapor-cell applications, both proposed and realized, include atomic clocks, communication system switches and buffers, single-photon generators and detectors, gas-phase sensors, nonlinear frequency generators, and precision spectroscopy instrumentation. However, most of these applications have only been created in laboratory settings.

Macroscale vapor cells are widely used in macroscale atomic clocks and as spectroscopy references. Macroscale vapor cells are typically 10-100 $cm^3$ in volume, which is insignificant for $m^3$ scale atomic clocks, but far too large for chip-scale atomic clocks which are at most a few $cm^3$ in volume.

A key driver has thus been to reduce vapor-cell size. Traditional vapor-cell systems are large and, if they have thermal control, have many discrete components and consume a large amount of power. To realize the full potential of vapor-cell technologies, the vapor-cell systems need to be miniaturized.

Chip-scale atomic clocks and navigation systems require miniature vapor cells, typically containing cesium or rubidium, with narrow absorption peaks that are stable over time. Miniature vapor cells, and methods of filling them with alkali metals, have been described in the prior art.

However, miniature vapor cells have higher surface-area-to-volume ratios than macroscale vapor cells. It is difficult to load a precise amount of alkali metal into a miniature vapor cell. Furthermore, the amount of alkali vapor in a vapor cell changes over time as the vapor adsorbs, diffuses, and reacts with the walls. Alkali metal vapor pressure may be changed with a small set of known technologies (see Monroe et al., *Phys Rev Lett* 1990, 65, 1571; Scherer et al., *J Vac Sci & Tech A* 2012, 30; and Dugrain, *Review of Scientific Instruments*, vol. 85, no. 8, p. 083112, August 2014). However, these systems are slow, complex, and/or have a short longevity.

A number of patents and patent applications discuss miniature vapor cells and methods of filling them with alkali metals. See U.S. Pat. No. 8,624,682 for "Vapor cell atomic clock physics package"; U.S. Pat. No. 8,258,884 for "System for charging a vapor cell"; U.S. Pat. No. 5,192,921 for "Miniaturized atomic frequency standard"; WO 1997012298 for "A miniature atomic frequency standard"; and WO 2000043842 for "Atomic frequency standard."

Traditionally, alkali metals have been introduced into magneto-optical trap (MOT) vacuum systems via difficult-to-control manual preparation steps, such as manually crushing a sealed alkali-containing glass ampule inside a metal tube connected to the vacuum system via a control valve. See Wieman, *American Journal of Physics*, vol. 63, no. 4, p. 317, 1995. This approach requires external heating to replenish the alkali metal inside the vacuum system as needed (a slow process with little control over the amount of alkali metal delivered). The manual labor is non-ideal for automated systems or chip-scale devices.

An alternative exists in the now-common alkali metal dispensers, which are effectively an oven-controlled source of alkali metal, whereby the desired alkali metal is released by chemical reaction when a current is passed through the device. While this process automates the release of alkali metal into the vacuum system, it has difficulty in fabrication compatibility with chip-scale cold-atom devices. Further, the timescales required for generating (warm up) and sinking (pump down) alkali are typically on the order of seconds to minutes, and can vary greatly depending on the amount of alkali metal built up on the vacuum system walls. Alkali metal dispensers also emit other gases initially, so they are not a clean source of alkali.

A rapidly pulsed and cooled variant of the alkali metal dispenser has been developed to stabilize the residual Rb vapor pressure in 100 millisecond pump down time, but the device requires large-dimension Cu heat sinks and complicated thermal design (Dugrain, *Review of Scientific Instruments*, vol. 85, no. 8, p. 083112, August 2014) which may not easily translate to miniaturization.

Double MOTs wherein the first MOT is loaded at moderate vacuum and then an atom cloud is transferred to a second high-vacuum MOT have been implemented on the laboratory scale. Again, these systems require complicated dual-vacuum systems and controls as well as a transfer system to move the atom cloud from one MOT to the other, none of which is amenable to chip-scale integration.

Light-induced atomic desorption (LIAD) is a recent technique that solves some of the long pump-down times by only releasing a small amount of alkali using a desorption laser; however, this method requires preparing a special desorption target in the MOT vacuum chamber. The desorption laser can interfere with the trapping lasers of the MOT (see Anderson et al., *Physical Review A*, vol. 63, no. 2, January 2001). It also has yet to demonstrate suitable time constants below 1 second.

Thermoelectric stages can be used to regulate the overall temperature of the vapor cell, but this requires the addition of the thermoelectric stages, a temperature sensor and controller, and a significant amount of power (watts) to maintain the entire temperature of the cell at the correct temperature for MOT operation. The effectiveness of this approach will also depend on the overall size of the MOT cell and the efficiency of the thermoelectric stages, limiting the time constants at which the MOT can be loaded and the residual pressure stabilized.

Atom chips use metal traces patterned via lithographic techniques to create magnetic fields involved in trapping populations of atoms. See U.S. Pat. No. 7,126,112 for "Cold atom system with atom chip wall"; Fortagh et al., *Rev. Mod. Phys.* 79, 235 (2007) Reichel et al., *Atom Chips*, Wiley, 2011; and Treutlein, *Coherent manipulation of ultracold*

*atoms on atom chips*, Dissertation, Ludwig-Maximilians-University Munich, 2008. Atom chips typically are implemented as one wall of a vapor cell. Thus they suffer from the same issues—such as slow vapor pressure rate of change and loss of alkali vapor to the walls—as conventional vapor cells.

Draper Laboratory has developed a solid-state ionic concept based on Cs conducting glass; see U.S. Pat. No. 8,999,123 and U.S. Patent App. Pub. No. 20110247942. However, the Draper technology suffers from two critical deficiencies. The Cs conducting glass has low ion conductivity. The implications of this are shown in Bernstein et al., "All solid state ion-conducting cesium source for atomic clocks," *Solid State Ionics* Volume 198, Issue 1, Pages 47-49 (2011), in which >1000 V applied voltage and elevated temperature (~170° C.) are required to change the alkali content on time scales of ~100 seconds.

Draper Laboratory discloses the use of a backside electrode which contains a metal (e.g. Ag) that is ionized and injected into the solid electrolyte, the metal being different from the desired atoms in the vapor phase of the vapor cell (e.g. Cs or Rb). This contaminates the solid electrolyte and limits the usable lifetime for the device. For example, a source of silver ions may be used to balance the lost $Cs^+$ ions from the ion-conducting glass. This will contaminate the ion-conducting glass over time and limit its longevity. It is also a source of additional complexity in the fabrication process.

Gold has been used as a source and sink of alkali atoms (Squires, "High repetition rate Bose-Einstein condensate production in a compact, transportable vacuum system," Ph.D. Thesis, University of Colorado, 2008). However, alkali interaction with gold is a surface effect due to the low diffusivity of alkali atoms in gold. The dense FCC crystal structure of gold leads to low diffusivities of alkali atoms. Gold films thus need to be made very thin, but that reduces any enhancement in alkali transport.

What is desired are vapor cells that work with lower voltages (such as 1-100 V), lower temperatures (such as 20-150° C.), and faster time response (such as 1-100 milliseconds). Response times less than 1 second are crucial because cold-atom lifetime is typically less than 1 second. The excess atoms must therefore be removed from the vapor chamber on time scales less than 1 second in order to have any effect on the cold-atom lifetime. A solution is also sought for the initial vapor-cell loading problem as well as the problem of a loss of alkali vapor over time.

SUMMARY OF THE INVENTION

The present invention addresses the aforementioned needs in the art, as will now be summarized and then further described in detail below.

In some variations, the present invention provides a vapor-cell system comprising a bidirectional solid-state electrochemical charge-depletion capacitor and a vapor-cell region configured to allow at least one optical path into a vapor phase within the vapor-cell region, wherein the charge-depletion capacitor includes:

(i) a first electrode disposed in contact with the vapor-cell region;

(ii) a second electrode electrically isolated from the first electrode; and (iii) an ion conductor interposed between the first electrode and the second electrode, wherein the first electrode is permeable to mobile ions and/or neutral atoms formed from the mobile ions;

wherein the ion conductor is ionically conductive for the mobile ions, and wherein the second electrode does not contain a second-electrode material that is capable of forming the mobile ions.

The charge-depletion capacitor may store electrical charge by reduction-oxidation reactions, electrosorption, intercalation, or combinations thereof.

In some embodiments, the charge-depletion capacitor has an actuation voltage of about 100 V or less, such as about 10 V or less.

In some embodiments, the vapor-cell system is characterized by a vapor-cell time constant for the mobile ions of less than 1 second, such as about 500 milliseconds or less, or about 100 milliseconds or less.

In some embodiments, the vapor-cell vapor phase contains a vapor-cell alkali metal, alkaline earth metal, or combination thereof. In these or other embodiments, the vapor-cell vapor phase may contain mercury, ytterbium, aluminum, cadmium, or a combination thereof.

The ion conductor may be ionically conductive for at least one ionic species selected from the group consisting of $Rb^+$, $Cs^+$, $Na^+$, $K^+$, and $Sr^{2+}$. The ion conductor may be characterized by an ionic conductivity at 25° C. of about $10^{-7}$ S/cm or higher, such as about $10^{-5}$ S/cm or higher.

The ion conductor may include alumina, β-alumina, β"-alumina, yttria-stabilized zirconia, NASICON, LISICON, KSICON, or combinations thereof. During operation of the vapor-cell system, the ion conductor contains the mobile ions (e.g., $Rb^+$, $Cs^+$, $Na^+$, $K^+$, and/or $Sr^{2+}$), and in some embodiments also immobile ions having opposite charge of the mobile ions (typically negatively charged immobile ions). The ion conductor may be initially ion-exchanged with an ionized version of an alkali metal or alkaline earth metal. During use, the ion conductor may ion-exchange with an ionized version of an alkali metal or alkaline earth metal.

The first electrode may be fabricated from a metal selected from the group consisting of platinum (Pt), molybdenum (Mo), tungsten (W), and combinations thereof, without limitation. The first electrode may be in the form of a mesh, a grid, a porous material with open porosity, a parallel line pattern, a microwire array, a nanowire array, a lithographically patterned network, or a combination thereof.

The second electrode is preferably not in contact with the vapor-cell region. The second electrode is preferably not permeable to the mobile ions or neutral atoms formed from the mobile ions. Also preferably, the second electrode does not contain a material that is capable of forming ions that are mobile in the ion conductor (i.e., not only the same mobile ions that are in the ion conductor but other ions which would be mobile in the ion conductor). The second electrode may be fabricated from a metal selected from the group consisting of Pt, Mo, W, and combinations thereof, without limitation.

In some embodiments, the system further comprises an atom chip contained within the vapor-cell region. The vapor-cell system may be configured to allow three vapor-cell optical paths into the vapor-cell vapor phase. The three vapor-cell optical paths may be geometrically orthogonal, or another configuration suitable for trapping a population of cold atoms, such as a pyramid configuration of optical paths.

Some variations provide a magneto-optical trap apparatus, the apparatus comprising:

(a) a bidirectional solid-state electrochemical charge-depletion capacitor;

(b) a vapor-cell region configured to allow three orthogonal optical paths into a vapor phase within the vapor-cell region;

(c) a source of laser beams configured to provide the three orthogonal vapor-cell optical paths through the vapor-cell gas phase, to trap a population of cold atoms; and (d) a magnetic-field source configured to generate magnetic fields within the vapor-cell region, wherein the charge-depletion capacitor includes:

(i) a first electrode disposed in contact with the vapor-cell region;

(ii) a second electrode electrically isolated from the first electrode; and (iii) an ion conductor interposed between the first electrode and the second electrode, wherein the first electrode is permeable to mobile ions and/or neutral atoms formed from the mobile ions;

wherein the ion conductor is ionically conductive for the mobile ions, and wherein the second electrode does not contain a second-electrode material that is capable of forming the mobile ions.

Some variations provide an atomic-cloud imaging apparatus, the apparatus comprising:

(a) a bidirectional solid-state electrochemical charge-depletion capacitor;

(b) a vapor-cell region configured to allow three orthogonal optical paths into a vapor phase within the vapor-cell region;

(c) a source of laser beams configured to provide the three orthogonal vapor-cell optical paths through the vapor-cell gas phase, to image a population of cold atoms; and (d) a magnetic-field source configured to generate magnetic fields within the vapor-cell region, wherein the charge-depletion capacitor includes:

(i) a first electrode disposed in contact with the vapor-cell region;

(ii) a second electrode electrically isolated from the first electrode; and (iii) an ion conductor interposed between the first electrode and the second electrode, wherein the first electrode is permeable to mobile ions and/or neutral atoms formed from the mobile ions;

wherein the ion conductor is ionically conductive for the mobile ions, and wherein the second electrode does not contain a second-electrode material that is capable of forming the mobile ions.

Other variations of the invention provide a method of using a vapor-cell system in forward operation, the method comprising:

(a) providing a vapor-cell system with a vapor-cell region and an electrochemical charge-depletion capacitor, wherein the charge-depletion capacitor comprises a first electrode disposed in contact with the vapor-cell region, a second electrode electrically isolated from the first electrode, and an ion conductor interposed between the first electrode and the second electrode, wherein the ion conductor is ionically conductive for mobile ions; and (b) pumping the mobile ions into the vapor-cell region in response to an electrical control signal applied to the first and second electrodes, wherein during step (b), immobile ions contained within the ion conductor are charge-balanced by a physically separated opposite charge on the second electrode, and wherein the mobile ions contained within the ion conductor migrate toward the first electrode and enter the vapor-cell region as neutral atoms.

Other variations of the invention provide a method of using a vapor-cell system in reverse operation, the method comprising:

(a) providing a vapor-cell system with a vapor-cell region and an electrochemical charge-depletion capacitor, wherein the charge-depletion capacitor comprises a first electrode disposed in contact with the vapor-cell region, a second electrode electrically isolated from the first electrode, and an ion conductor interposed between the first electrode and the second electrode, wherein the ion conductor is ionically conductive for mobile ions; and (b) pumping neutral atoms out of the vapor-cell region in response to an electrical control signal applied to the first and second electrodes, wherein during step (b), immobile ions contained within the ion conductor are charge-balanced by a physically separated opposite charge on the second electrode, and wherein the neutral atoms migrate from the vapor-cell region to the first electrode and then migrate as the mobile ions through the ion conductor toward the second electrode.

In some embodiments of these methods, the vapor-cell region is configured to allow at least one vapor-cell optical path into a vapor-cell vapor phase within the vapor-cell region. Preferably, the vapor-cell system is configured to allow three vapor-cell optical paths into the vapor-cell vapor phase. The three vapor-cell optical paths may be geometrically orthogonal or pyramidal, for example.

The vapor-cell region may contain an alkali metal, alkaline earth metal, or combination thereof. In some embodiments, the ion conductor may be ionically conductive for at least one ionic species selected from the group consisting of $Rb^+$, $Cs^+$, $Na^+$, $K^+$, and $Sr^{2+}$.

DETAILED DESCRIPTION OF EMBODIMENTS OF THE INVENTION

Figure 1:
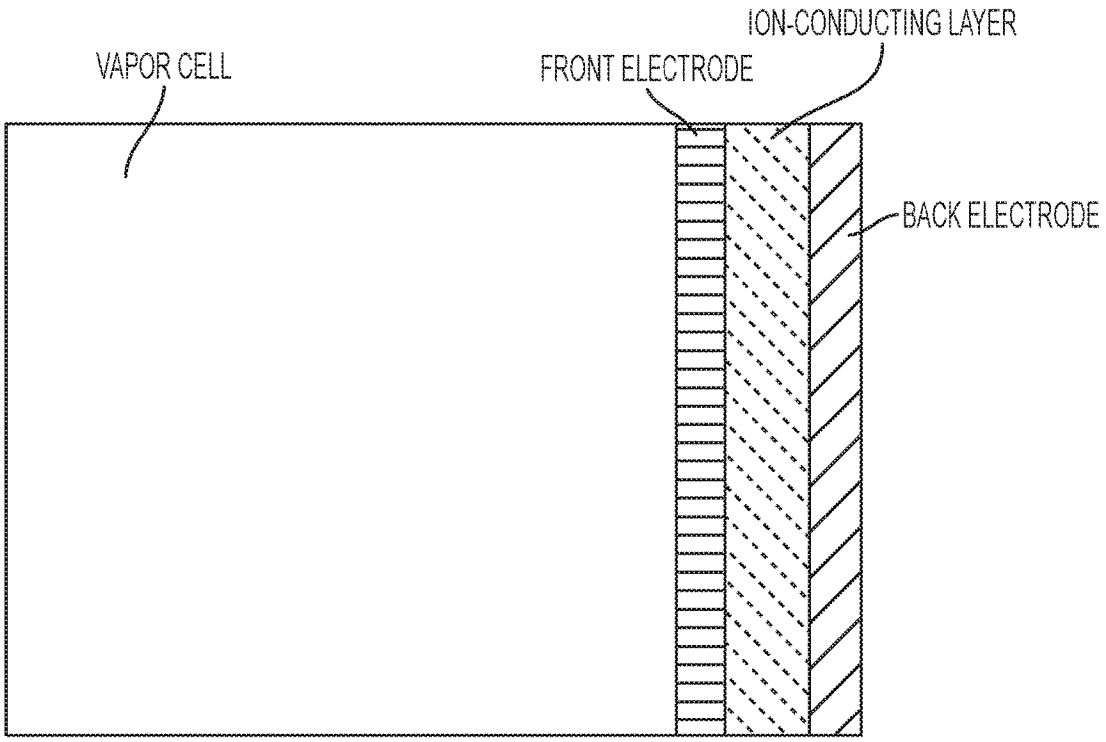
FIG. 1 is a schematic of an exemplary bidirectional solid-state charge-depletion capacitor alkali source/sink, in some embodiments.

The structures, systems, and methods of the present invention will be described in detail by reference to various non-limiting embodiments.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Some variations of this disclosure provide an alkali metal and/or alkaline earth metal vapor cell with an ion conductor which is used as both a source and/or a sink for the alkali metal and/or alkaline earth metal atoms, thus enabling electrical control over alkali and/or alkaline earth content of the vapor cell. Preferably, there is no reservoir or other source of make-up ions which would contribute to system complexity and impede miniaturization. Instead, preferably the vapor cell is configured to generate (or annihilate) an ion-depletion layer as part of an electrochemical capacitor to transport alkali metal and/or alkaline earth metal atoms into (or out of) the ion conductor in response to an electrical control signal.

The present invention, in preferred variations, utilizes an electrochemical "charge-depletion capacitor" (or equivalently, an "ion-depletion capacitor") which does not require any make-up ions. Charge-depletion capacitors store electrical energy by electron charge transfer, termed "charge-depletion capacitance" (or equivalently, "ion-depletion capacitance"). The charge-depletion capacitance may be accomplished by electrosorption, reduction-oxidation reactions, and/or intercalation processes. Charge-depletion capacitance is accompanied by an electron charge transfer between electrode and a de-solvated and adsorbed ion. Typically, the adsorbed ion has no chemical reaction with the atoms of the electrode since only a charge transfer takes place. An example is a redox reaction wherein during charging, one electrode hosts a reduction reaction and the other electrode hosts an oxidation reaction. Under discharge, the reactions are reversed. Charge-depletion capacitors enable low time constants (less than 1 second) for the vapor-cell systems herein.

For convenience, "alkali" or "alkali metal" may be used in this specification to refer to one or more alkali metals, one or more alkaline earth metals, or a combination thereof. Alkali metals include Li, Na, K, Cs, Rb, and Fr. Alkaline earth metals include Be, Mg, Ca, or Sr, Ba, and Ra. Other metals such as Hg or Yb may be desirable for certain atomic clock applications. The principles of the invention may be applied to Hg, Yb, or other suitable elements. For convenience, this disclosure refers to alkali atoms as exemplary.

Also, "source," "sink," "source and/or sink", "source/sink" or the like may be used herein to refer to a source of alkali metals and/or alkaline earth metals; a sink of alkali metals and/or alkaline earth metals; or a material or structure that acts as either a source or sink of alkali metals and/or alkaline earth metals, depending on local conditions (e.g., temperature, pressure, or electrical potential), concentrations of species, etc.

Some variations of the invention enable long population lifetimes of cold atoms, particularly in miniaturized atomic systems. Cold atoms (such as at temperatures of about 1 μK to about 1 K, typically from about 100 μK to about 1000 μK) are useful for precision timing and navigation applications. Cold atoms are typically formed from a subset of warmer atoms inside a vapor cell, e.g. through trapping and cooling in a magneto-optical trap (MOT). The time constant of the cold-atom population depends on the density of other atoms in the vapor cell because of collisional heating. For fast loading (i.e. short time constant on loading), it is desirable to have a high vapor density of atoms. However, for highly stable and highly precise measurement it is desirable to have the population of cold atoms last as long as possible; thus a long time constant and low vapor density are preferred once the population of cold atoms has been cooled and trapped. In order to achieve both a fast loading time and long lifetime, it is desirable to actively control the vapor density in a vapor cell. It has been discovered by the present inventors that ion conductors can be utilized to effectively control alkali vapor pressure in vapor cells.

This invention enables active, bidirectional control of alkali metal and alkaline earth metal vapor pressure within a vapor cell. The present invention overcomes the initial loading problem by allowing a vacuum to be sealed and using an ion-conducting layer as the alkali source. The present invention also overcomes the problem of a loss of alkali vapor over time by enabling reloading of additional alkali vapor to replace what has been lost to the walls.

Some embodiments enable low voltages (such as about 1-100 V) to reload additional alkali vapor, low temperatures (such as 25° C.) to change alkali content, and fast time responses to remove excess atoms from the vapor chamber. Fast time responses, in some embodiments, include vapor-cell time constants less than 1 second, such as about 1, 5, 10, 50, 100, 200, 300, 400, 500, 600, 700, 800, or 900 milliseconds.

Advantages in some embodiments over previous art include, but are not limited to: bidirectional control through electrically reversible operation, thus serving as both a source and a sink; rapid (<1 second) operation through the use of superionic conductors, such as β-alumina or (β"-alumina, which have high ionic conductivity; and simplified design and fabrication through the elimination of the need for a reservoir of make-up ions.

Vapor chamber walls need to be at least partially transparent to allow optical access to the alkali metal atoms and/or alkaline earth metal atoms inside for laser cooling and measurement purposes. Typically, the majority of the wall area is transparent. Also typically, alkali sources and sinks are opaque.

A bidirectional solid-state charge-depletion capacitor alkali source and/or sink includes a vapor chamber volume; an ion conductor; at least one first electrode; and at least one second electrode.

In some variations, the present invention provides a vapor-cell system comprising a bidirectional solid-state electrochemical charge-depletion capacitor and a vapor-cell region configured to allow at least one optical path into a vapor phase within the vapor-cell region, wherein the charge-depletion capacitor includes:

(i) a first electrode disposed in contact with the vapor-cell region;

(ii) a second electrode electrically isolated from the first electrode; and (iii) an ion conductor interposed between the first electrode and the second electrode, wherein the first electrode is permeable to mobile ions and/or neutral atoms formed from the mobile ions;

wherein the ion conductor is ionically conductive for the mobile ions, and wherein the second electrode does not contain a second-electrode material (other than trivial amounts) that is capable of forming the mobile ions.

Within the vapor chamber volume, the vapor chamber contains an atomic vapor, preferably that of an alkali metal or an alkaline earth metal. Optionally, the atomic vapor is isotopically enriched or purified. When the alkali or alkaline earth metal is isotopically enriched, the relative abundance of the isotopes of a given element are altered, thus producing a form of the element that has been enriched in one particular isotope and depleted in its other isotopic forms. The alkali or alkaline earth metal may be isotopically pure, which means it is composed entirely of one isotope of the selected alkali or alkaline earth metal(s).

In some embodiments, the vapor chamber contains nothing but the atomic vapor as a rarefied gas, i.e. the vapor chamber is under partial vacuum.

In other embodiments, the vapor chamber contains additional gases in addition to the atomic vapor. Additional gases may be selected from $N_2$, $CH_4$, He, Ar, Ne, Xe, $NH_3$, $CO_2$, $H_2O$, $H_2$, or mixtures of these or other molecules, for example. Non-metal atoms (e.g., elemental H, N, or O) may also be used as additional gases. The other gas or gases may be used as a buffer gas or as a spin exchange gas, for example. Optionally, the other gas or gases may be isotopically enriched or purified. Any additional gas is preferably not reactive with the alkali or alkaline earth metal.

The vapor chamber may be hermetically sealed. The vapor chamber may also be configured in fluid communication with a larger system, which may or may not be collectively (with the vapor chamber) hermetically sealed. The larger system, for example, could be part of a high-vacuum system containing pumps, pressure/vacuum gauges, atom dispensers, getters, getter pumps, getter sources, pill sources, etc.

One or more walls of the vapor chamber volume are at least partially transparent, and preferably substantially transparent, at relevant wavelengths such that there is an optical path through the vapor cell volume. It is preferred that the optical path go through the vapor cell—that is, from one wall to another wall. In some embodiments, a laser beam may enter the vapor cell, reflect off a mirrored surface inside the cell, and leave the cell through the same side that it entered. In some embodiments, a laser beam may enter the vapor cell, diffract off or through a grating, and leave the cell through the same side or another side.

Walls enclose the vapor-cell region, sealing it from the ambient environment. The walls may be fabricated from silicon, $SiO_2$, fused silica, quartz, pyrex, metals, dielectrics, or a combination thereof, for example. At least one of the walls includes a transparent portion such that there is an optical path through the vapor-cell region. A wall can be made transparent either by fabricating from an optically transparent material, or by including an optical window in a part of the wall.

The vapor chamber volume may be configured to allow three orthogonal optical paths to facilitate the formation of a magneto-optical trap and for atomic cloud imaging.

The ion conductor preferably has high ionic conductivity for an ionic species. The ionic species is preferably an alkali metal or alkaline earth metal ion, such as (but not limited to) one or more of $Na^+$, $K^+$, $Rb^+$, $Cs^+$, or $Sr^{2+}$. The ionic conductivity, measured at 25° C., is preferably about $10^{-7}$ S/cm or higher, more preferably about $10^{-5}$ S/cm or higher. In various embodiments, the ion conductivity of the ion conductor at 25° C. is about $10^{-8}$ S/cm, $10^{-7}$ S/cm, $10^{-6}$ S/cm, $10^{-5}$ S/cm, $10^{-4}$ S/cm, $10^{-3}$ S/cm, or $10^{-2}$ S/cm.

It is desirable to have an ion conductor with a high permittivity. This will lead to a higher charge-depletion capacitance and thus lower actuation voltages for a given quantity of alkali atoms.

The ion conductor is preferably a solid electrolyte, in some embodiments. For example, the ion conductor may be a large fraction (>50% by weight) β-alumina, β"-alumina, or a combination of β-alumina and β"-alumina. Beta-alumina solid electrolyte (BASE) is a fast ion-conductor material used as a membrane in several types of electrochemical cells. β-alumina and β"-alumina are good conductors of their mobile ions yet allows negligible non-ionic (i.e., electronic) conductivity. β"-alumina is a hard polycrystalline or monocrystalline ceramic which, when prepared as an electrolyte, is complexed with a mobile ion, such as $Na^+$, $K^+$, $Li^+$, and/or an ionic version of the alkali or alkaline earth metal. Other possible solid electrolyte materials include yttria-stabilized zirconia, NASICON, LISICON, KSICON, and combinations thereof. When the ion conductor is hygroscopic, it is desirable to avoid any contact with ambient or humid air.

In some embodiments, the ion conductor is thin, such as from about 1 nanometer to about 100 microns. One method of making the ion conductor thin is chemical mechanical polishing, followed by appropriate bakeout of the ion-conductor material at suitably high temperature and/or suitably long duration. Another method of making the ion conductor thin is to deposit it conformally on the walls of a preformed transparent vacuum chamber using a deposition process, such as solution deposition or deposition followed by calcination, of a hydrated alumina gel for example.

A first electrode is in contact with both the ion conductor and the vapor chamber volume. Both the first electrode and the ion conductor may form part of the inner walls of the vapor chamber. It is desirable that the first electrode (and potentially the ion conductor) form as much of the inner wall of the vapor chamber as possible without compromising the optical access. This will increase the rate of vapor transport.

Exemplary first electrode materials include Pt, Mo, or W, in certain embodiments. The electrode may include more than one layer, such as a Ti adhesion layer and a Pt layer. In some embodiments, the first electrode does not contain Ni, Ag, or Au. It is desirable that an electrical potential, when applied, does not vary considerably (e.g. <0.1 V difference) across the electrode surface. The electrode thickness is selected, in some embodiments, as a function of the electrode material resistivity and the expected ionic current through the ion conductor.

Other first electrode structures include, but are not limited to, metallic microwire and nanowire networks and lithographically patterned metallic networks. Another electrode option is a conductive film such as TiN or metallic films. Such films may be deposited with atomic layer deposition or evaporation, for example. Another first electrode option is a conductive graphene monolayer or graphene multilayer.

The first electrode is preferably designed to have a large amount of three-phase contact length or interfacial contact area. The three phases are electrode, ion conductor, and atomic vapor. Configurations that may accomplish high three-phase contact include a high-density mesh or grid pattern, a porous material with an open porosity, a high-density parallel line pattern, or a nanowire array, for example.

The first electrode preferably does not chemically interact with the ionic species. That is, the first electrode preferably does not form an intermetallic phase and preferably does not chemically react with the ionic species. Also, the first electrode preferably does not chemically interact with the ion conductor; the first electrode preferably does not form ions that are mobile within the ion conductor.

The first electrode preferably has high ionic permeability for the ionic species that is conducted by the ion conductor or a neutral species formed from the ionic species. The high ionic permeability may be realized by high ionic conductivity through the electrode material itself, such as a first-electrode ionic conductivity of about $10^{-8}$ S/cm, $10^{-7}$ S/cm, $10^{-6}$ S/cm, $10^{-5}$ S/cm, $10^{-4}$ S/cm, $10^{-3}$ S/cm, or $10^{-2}$ S/cm measured at 25° C. Alternatively, or additionally, the high ionic permeability may be realized by through-holes in the first electrode, in which ionic species or neutral species formed from the ionic species are able to transport directly from the vapor-cell region to the ion conductor, or diffuse through porous paths contained in the first electrode.

The second electrode is not in electrical contact with the first electrode. Preferably, the second electrode is not in physical contact with the vapor chamber volume. The second electrode is, however, in contact with the ion conductor. The second electrode preferably contacts as large of an area as possible of the ion conductor to increase the electrochemical charge-depletion capacitance. For instance, the ion conductor (and/or the back electrode) may have a roughened, etched, trenched, crenellated, or ridged back surface to increase the contact area between itself and the second electrode.

Exemplary second electrode materials include Pt, Mo, or W, in certain embodiments. The second electrode may include more than one layer, such as a Ti adhesion layer and a Pt layer. In some embodiments, the second electrode does not contain Ni, Ag, or Au. It is desirable that an electrical potential, when applied, does not vary considerably (e.g. <0.1 V difference) across the second electrode surface. The second electrode thickness is selected, in some embodiments, as a function of the electrode material resistivity and the expected ionic current through the ion conductor. Other second electrode structures may include metallic microwire and nanowire networks and lithographically patterned metallic networks. The second electrode is preferably a solid material that is not permeable to the mobile ions or neutral atoms formed from the mobile ions.

The second electrode preferably does not chemically interact with the ion conductor. Also, the second electrode preferably does not form ions that are mobile within the ion conductor. The second electrode preferably has low ionic permeability for the ionic species (conducted by the ion conductor) and for a neutral species formed from the ionic species. The ionic conductivity of the second electrode may be less than about $10^{-5}$ S/cm, $10^{-6}$ S/cm, $10^{-7}$ S/cm, $10^{-8}$ S/cm, or $10^{-9}$ S/cm, measured at 25° C.

The first and second electrodes are typically connected to electrical leads each fabricated from an electrically conductive material. A lead is an electrical connection consisting of a length of wire, metal pad, metal trace, or other electrically conductive structure. Leads are used to transfer power and may also provide physical support and potentially provide a heat sink. In some embodiments, a device is provided without such leads, which may be added at a later time, before operation.

The electrical leads allow electrical control of the vapor cell, i.e. the ability to pump mobile ions into the vapor-cell region, or neutral atoms out of the vapor-cell region, in response to an electrical control signal applied to the first and second electrodes. An "electrical control signal" refers to electrical current applied to the electrodes by means of electrical leads, electrical traces, or other electrical means, to pump species into or out of the vapor cell using charge-depletion capacitance. Similarly, "actuation voltage" means voltage applied across the two electrodes, to pump species into or out of the vapor cell using charge-depletion capacitance. The actuation voltage may vary widely, such as from about 0.1 V to about 500 V, or about 0.5 V to about 100 V, e.g. about 1, 2, 3, 4, 5, 10, 20, 30, 40, 50, 60, 70, 80, 90, or 100 V. The electrical control signal current and/or the actuation voltage may be controlled via a computer.

A number of variations of the system and device are possible. Several variations will now be described, without limiting the scope of the invention.

The vapor cell may or may not be situated inside a magnetic field. Magnetic trapping fields may be generated inside or outside the vapor cell. For example, coils of wire driven in an anti-Helmholtz configuration surrounding the vapor cell may be used to generate the magnetic fields required for an atom trap. Other magnetic-field sources (such as magnets or materials capable of generating magnetic flux) may be utilized to generate magnetic fields within the vapor-cell region.

The vapor cell may or may not be contained within an oven. The purpose of the oven may be to control the temperature of the vapor cell at a temperature above the ambient temperature. In principle, the vapor cell may be contained within any sort of temperature-controlled system, for heating or cooling the vapor cell.

The vapor cell, or system containing the vapor cell, may include one or more heaters to increase temperature and thus increase the ionic conductivity of the ion-conducting layer. The higher temperature may be used to temporarily, periodically, or constantly increase the ionic conductivity of the ion-conducting layer. The heater is preferably a resistive heater, but may also be a thermoelectric heater, for example. In some embodiments, the heater is patterned directly on the ion conductor. Alternatively, or additionally, the heater may be patterned on another part of the device or simply attached to a part of the device.

The temperature of an oven may be set to control the temperature of the vapor cell at a set-point temperature. The partial pressure of the buffer gas (if present) may be controlled by the set-point temperature. The set-point temperature and the concentration of the alkali or alkaline earth metal in the vapor-cell region may be chosen, in some embodiments, such that all of the alkali or alkaline earth atoms are in the vapor phase.

The device may be implemented at a wide variety of length scales. The length scale may be characterized by the cube root of the vapor chamber volume. In various embodiments, the length scale can vary from 10 m down to 1 nm. Typically, the length scale is about 10 mm to 1 m for macroscale atomic timing and navigation systems, and about 10 microns to 10 mm for chip-scale atomic timing and navigation systems. Chip-scale devices are preferably constructed using microfabrication techniques, including some or all of lithography, shadow-masking, evaporation, sputtering, wafer bonding, die bonding, anodic bonding, glass frit bonding, metal-metal bonding, and etching.

Multiple ion conductors, each with their own electrodes, may be present in a single device. The multiple front electrodes may or may not be electrically connected through electrical leads or electrical traces. Likewise, the multiple back electrodes may or may not be electrically connected through electrical leads or electrical traces.

Multiple sets of front electrodes, ion conductors, and back electrodes may be present in the system. In some embodiments, two or more front electrodes are employed. In these or other embodiments, two or more back electrodes are employed. In any of these embodiments, or other embodiments, two or more ion conductors are employed. Many combinations are possible.

The vapor cell may also contain an atom chip for intra-system generation of magnetic fields for microtraps. There are many variations of this design.

In some embodiments, an atom chip is disposed on a different vapor cell face from a bidirectional solid-state charge-depletion capacitor alkali source.

In some embodiments, an atom chip is fabricated on a base chip that is heterogeneously integrated with the bidirectional solid-state charge-depletion capacitor alkali source, on the same vapor cell face. The atom chip may be closer to the vapor cell volume than the ion conductor, in which case the alkali atoms can pass around the edges of the atom chip or through one of more (optional) holes in the atom chip. The ion conductor may be closer to the vapor cell than the atom chip, in which case the trapped population of cold atoms may be situated above the ion conductor. Note that the atom chip and the ion conductor need not be the same size.

In some embodiments, an atom chip is fabricated directly on the bidirectional solid-state charge-depletion capacitor alkali source. The atom chip traces that generate the magnetic fields for microtraps will usually be adjacent to the top electrode traces in this case. The atom chip traces that generate the magnetic fields for microtraps may be separated from the ion conductor by a material which is both an electronic insulator and an ion insulator (e.g., certain glass materials).

When a vapor-cell system includes an atom chip contained within the vapor-cell region, the system may be configured to allow three vapor-cell optical paths into the vapor-cell vapor phase. The three vapor-cell optical paths may be geometrically orthogonal, or another configuration suitable for trapping a population of cold atoms, such as a pyramid configuration of optical paths.

Some variations of the invention provide a magneto-optical trap apparatus, the apparatus comprising:

a vapor-cell region configured to allow three orthogonal vapor-cell optical paths into a vapor-cell gas phase within the vapor-cell region;

a first electrode disposed in contact with the vapor-cell region;

a second electrode that is electrically isolated from the first electrode;

an ion conductor interposed between the first electrode and the second electrode, wherein the ion conductor is ionically conductive for mobile ions;

a source of laser beams configured to provide the three orthogonal vapor-cell optical paths through the vapor-cell gas phase, to trap a population of cold atoms; and a magnetic-field source configured to generate magnetic fields within the vapor-cell region.

Some embodiments provide a magneto-optical trap apparatus, the apparatus comprising:

a vapor-cell region configured to allow three or more vapor-cell optical paths into a vapor-cell gas phase within the vapor-cell region;

a first electrode disposed in contact with the vapor-cell region;

a second electrode that is electrically isolated from the first electrode;

an ion conductor interposed between the first electrode and the second electrode, wherein the ion conductor is ionically conductive for mobile ions;

a source of laser beams configured to provide the three or more vapor-cell optical paths through the vapor-cell gas phase, in a pyramid configuration, to trap a population of cold atoms; and a magnetic-field source configured to generate magnetic fields within the vapor-cell region.

Some variations of the invention provide an atomic-cloud imaging apparatus, the apparatus comprising:

a vapor-cell region configured to allow three orthogonal vapor-cell optical paths into a vapor-cell gas phase within the vapor-cell region;

a first electrode disposed in contact with the vapor-cell region;

a second electrode that is electrically isolated from the first electrode;

an ion conductor interposed between the first electrode and the second electrode, wherein the ion conductor is ionically conductive for mobile ions;

a source of laser beams configured to provide the three orthogonal vapor-cell optical paths through the vapor-cell gas phase, to image a population of cold atoms; and a magnetic-field source configured to generate magnetic fields within the vapor-cell region.

Some variations of the invention provide an atomic-cloud imaging apparatus, the apparatus comprising:

a vapor-cell region configured to allow three or more vapor-cell optical paths into a vapor-cell gas phase within the vapor-cell region;

a first electrode disposed in contact with the vapor-cell region;

a second electrode that is electrically isolated from the first electrode;

an ion conductor interposed between the first electrode and the second electrode, wherein the ion conductor is ionically conductive for mobile ions;

a source of laser beams configured to provide the three or more vapor-cell optical paths through the vapor-cell gas phase, in a pyramid configuration, to image a population of cold atoms; and a magnetic-field source configured to generate magnetic fields within the vapor-cell region.

In some embodiments, vapor cells have independent alkali (or alkaline earth) vapor pressure control. An alkali metal or alkaline earth metal vapor cell may be configured with a solid electrolyte used to transport alkali or alkaline earth atoms between the vapor cell and a reserve reservoir, thus enabling electrical control over alkali or alkaline earth content of the vapor cell. The solid electrolyte can control the alkali or alkaline earth vapor pressure within the vapor cell.

A vapor cell oven enables independent control over the alkali or alkaline earth partial pressure and an optional buffer gas partial pressure in the vapor cell. In some embodiments, the buffer gas partial pressure is controlled by the oven temperature and the alkali or alkaline earth partial pressure is controlled by the voltage and current applied across the solid electrolyte. As conditions in the vapor cell change over time, the oven temperature and alkali or alkaline earth partial pressure can be adjusted to maintain a narrow, stable absorption peak. Because the alkali or alkaline earth concentration may be adjusted after the vapor cell is sealed, precision loading of alkali or alkaline earth metal is not necessary, thus making the sealing process significantly easier.

Variations of this invention enable a miniature vapor cell with a narrow, stable absorption peak. A miniature vapor cell with a narrow, stable absorption peak may be useful for miniature position, navigation, and timing systems, among other uses.

The system may include a membrane which deflects as the pressure inside the vapor cell changes. The deflection could be read out with an electrical signal (e.g. piezoelectric, capacitive, differential capacitive, etc.). The membrane could deflect as the pressure between the vapor cell and a reference cell changes. The reference cell may contain vacuum or may contain a substance in vapor-solid or vapor-liquid equilibrium such that the pressure inside the reference cell would be known by knowing the temperature of the reference cell.

The system may be configured to allow a secondary optical path through the reservoir region. Multiple laser beams may be employed, or the beam of a single laser may be split to interrogate both the primary and secondary optical paths. The difference in absorption between the two paths may be used to sense the difference in alkali or alkaline earth vapor pressure between the two chambers. If the alkali or alkaline earth in the reservoir is in a vapor-liquid or solid-vapor equilibrium, then the vapor pressure in the reservoir is known if the temperature of the reservoir is known. Thus, the vapor pressure of the alkali or alkaline earth in the vapor cell can be determined by knowing the difference in absorption between the two optical paths and the temperature of the reservoir.

An "optical path" is the path of a spectroscopic probing beam of light (or other type of laser beam) into the alkali or alkaline earth vapor-cell region, or in some cases, into a reservoir region. The optical path is optional in the sense that the device itself does not inherently include the beam of light, while operation of the device will at least periodically mean that an optical path is traversing into or through the alkali or alkaline earth vapor-cell region. Also note that an optical path is not necessarily a straight line. Internal reflectors may be included in the system, so that optical reflection occurs. In that case, the optical beam could enter and exit along the same wall (detection probe on the same side as the laser source), for example.

Reference is now made to the accompanying drawings, which should not be construed as limiting the invention in any way, but will serve to illustrate various embodiments.

FIG. 1 is a schematic of an exemplary bidirectional solid-state charge-depletion capacitor alkali source/sink, in some embodiments. A front electrode is disposed in communication with a vapor cell. An ion conductor is interposed between the front electrode and a back electrode. In some embodiments, the back electrode is configured to operate as an electrochemical charge-depletion capacitor. The device shown in FIG. 1 may be used as an alkali source or as both a source and a sink.

Figure 2:
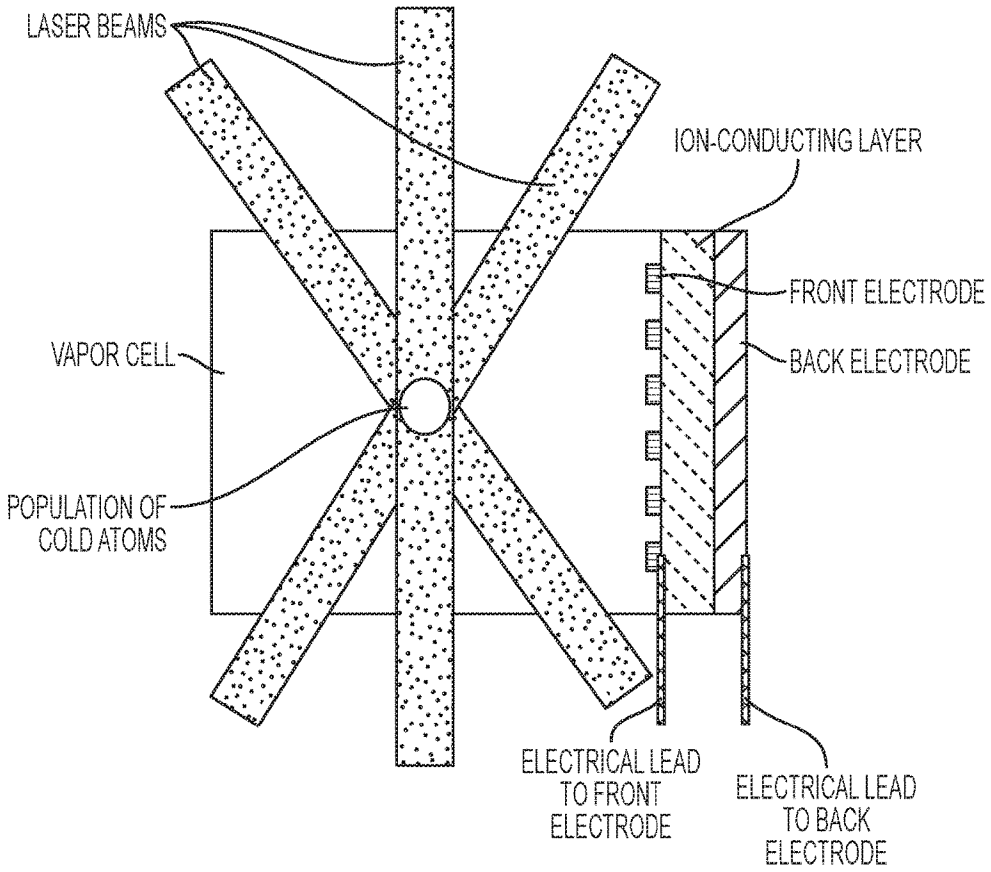
FIG. 2 is a schematic of a variation on a bidirectional solid-state charge-depletion capacitor alkali source/sink showing laser beams passing through three optical paths in the vapor cell and trapping a population of cold atoms.

FIG. 2 is a schematic of a variation on a bidirectional solid-state charge-depletion capacitor alkali source/sink showing laser beams passing through three optical paths in the vapor cell and trapping a population of cold atoms. The three optical paths are preferably orthogonal in three dimensions. Magnetic field lines and a source of the magnetic field, which also play a role in the trapping of the cold atoms, are not depicted in FIG. 2. A front electrode is disposed in communication with the vapor cell. An ion conductor is interposed between the front electrode and a back electrode. Electrical leads are disposed in electrical communication with each of the front and back electrodes.

It shall be understood that laser beams may or may not be present in any vapor cell described in this specification. That is, a source of laser beams may be present but not operating, in which case no laser beams will enter or be present within the vapor-cell region. Or a vapor cell may be provided without a source of laser beams, which source may be added at a later time, prior to operation of the vapor-cell system. In any event, the laser beams are omitted from the drawings (except FIG. 2) for clarity, it being understood that laser beams may be present. The remaining drawings (FIGS. 1 and 3-9) do not explicitly depict laser beams or optical paths, it being understood that that laser beams may or may not be actually present. Similarly, the drawings do not explicitly depict a laser-beam source (e.g., laser-generating apparatus), magnetic field lines, or a source of magnetic field, all of which may be present.

Figure 3:
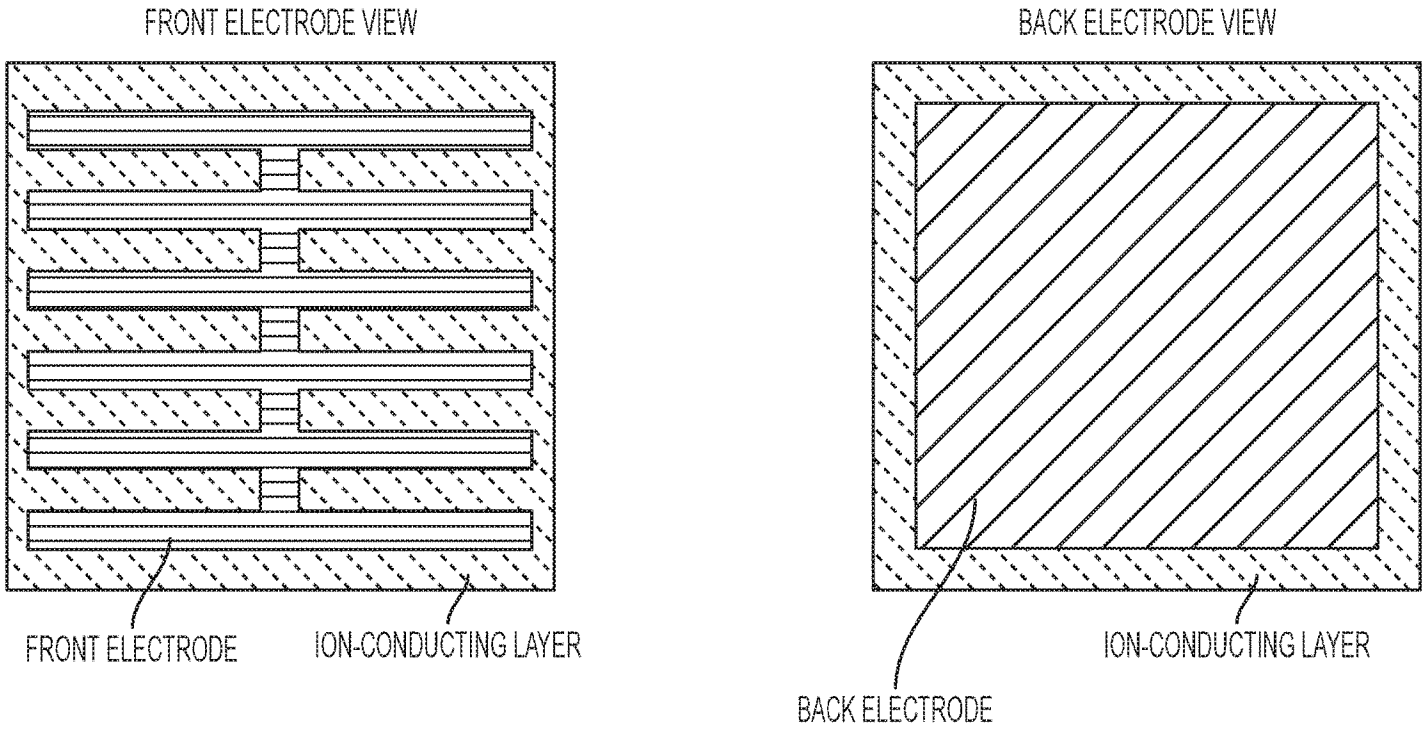
FIG. 3 is a schematic of views of the front and back electrodes on a bidirectional solid-state charge-depletion capacitor alkali source/sink, in some embodiments.

FIG. 3 is a schematic of views of the front and back electrodes on a bidirectional solid-state charge-depletion capacitor alkali source/sink, in some embodiments. An ion conductor is interposed between the front electrode, on one side, and a back electrode, on the opposite side.

Figure 4:
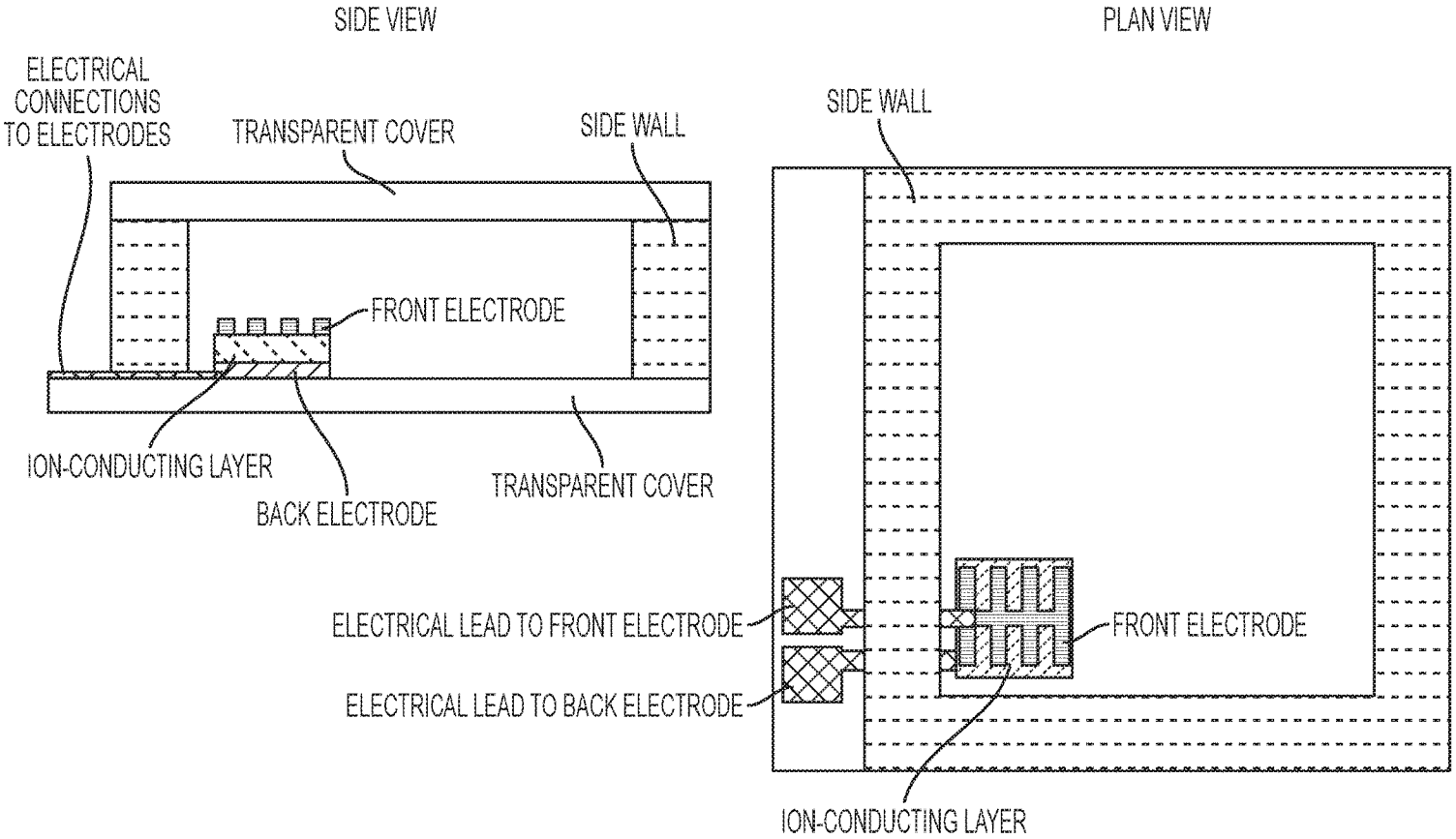
FIG. 4 is a schematic of a side view and a plan view of a chip-scale variation on a bidirectional solid-state charge-depletion capacitor alkali source/sink, in some embodiments.

FIG. 4 is a schematic of a side view and a plan view of a chip-scale variation on a bidirectional solid-state charge-depletion capacitor alkali source/sink, in some embodiments. Within a vapor-cell region, an ion conductor is interposed between a front electrode and a back electrode, which each are electrically connected to electrical leads. The vapor-cell region is enclosed by side walls and a transparent cover.

Figure 5:
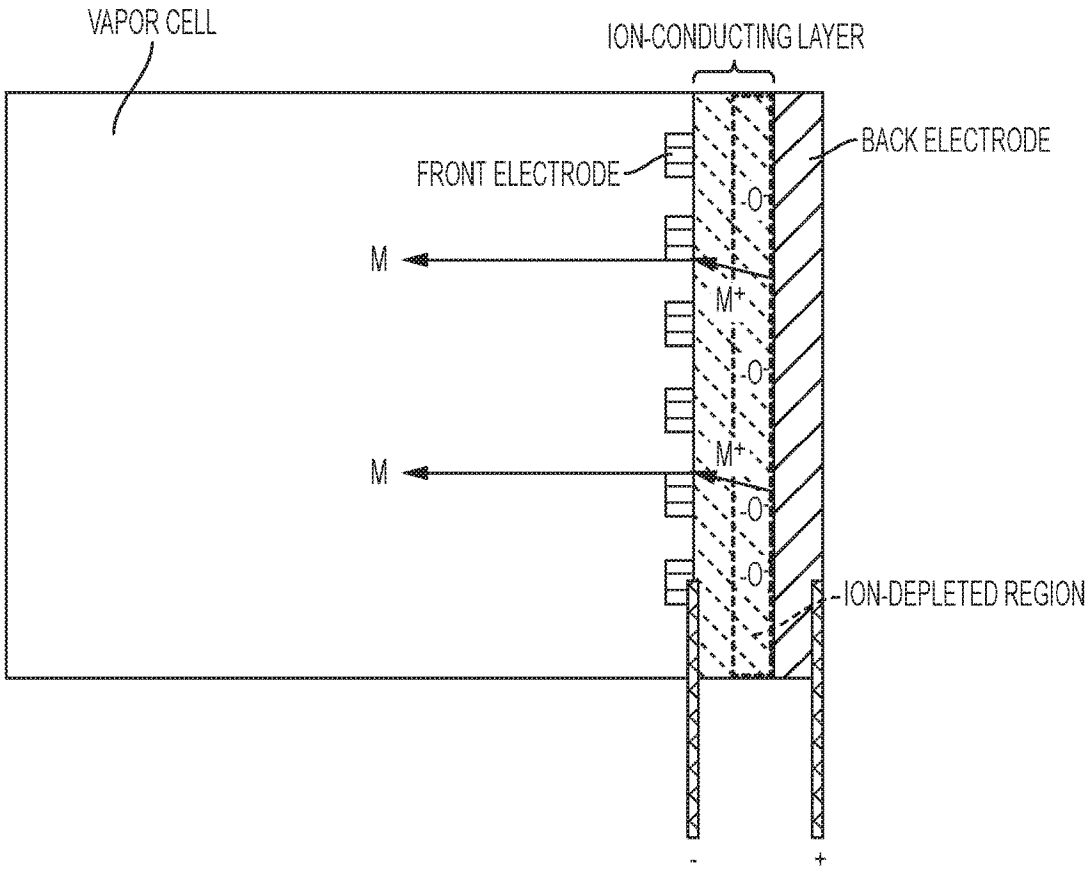
FIG. 5 is a schematic of a bidirectional solid-state charge-depletion capacitor alkali source/sink in forward operation, in which alkali metal atoms are being pumped into the vapor-cell volume.

FIG. 5 is a schematic of a bidirectional solid-state charge-depletion capacitor alkali source/sink in forward operation, in which alkali metal atoms are being pumped into the vapor-cell volume. A front electrode is disposed in communication with a vapor cell. An ion conductor (ion-conducting layer) is interposed between the front electrode and a back electrode. In operation, an ion-depleted region forms within the ion-conducting layer, in which the ion-depleted region becomes depleted in mobile positive ions (indicated as $M^+$) and in which immobile negative ions (indicated as $—O^-$) remain. The immobile negative ions form a charge-depletion capacitor balanced by the physically separated positive charge on the back electrode. The mobile positive ions migrate toward the front electrode (which has a negative charge), pick up electrons at the front electrode (converting $M^+$ to M), and enter the vapor-cell volume as neutral atoms M.

Figure 6:
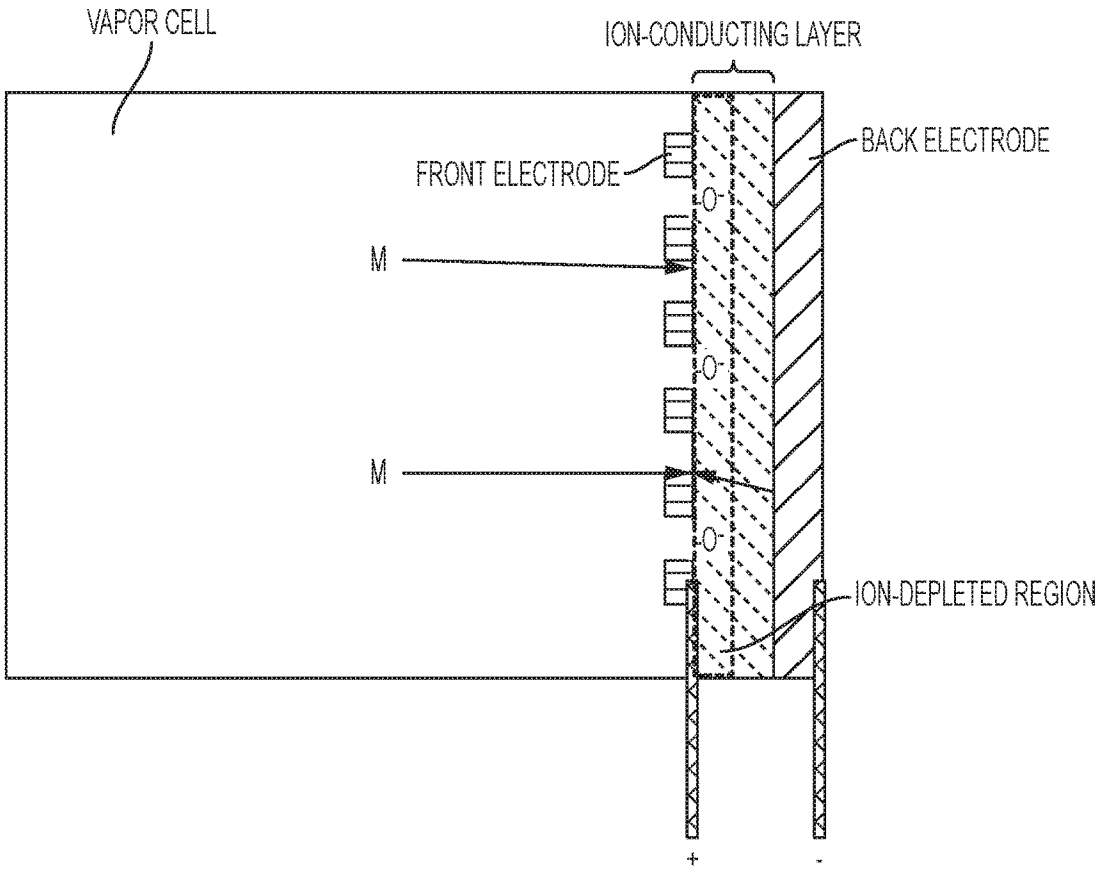
FIG. 6 is a schematic of a bidirectional solid-state charge-depletion capacitor alkali source/sink in reverse operation, in which alkali metal atoms are being evacuated from the vapor-cell volume.

FIG. 6 is a schematic of a bidirectional solid-state charge-depletion capacitor alkali source/sink in reverse operation, in which alkali metal atoms are being evacuated from the vapor-cell volume. A front electrode is disposed in communication with a vapor cell. An ion conductor (ion-conducting layer) is interposed between the front electrode and a back electrode. In such reverse operation, immobile negative ions (indicated as $—O^-$) form a charge-depletion capacitor balanced by the physically separated negative charge on the back electrode. Metals M are pumped out of the vapor-cell volume, lose electrons, and migrate as positive ions toward the negatively charged back electrode. An ion-depleted region forms within the ion-conducting layer. The mobile positive ions can combine with the immobile negative ions to form neutral metal species, intercalate within the ion-conducting layer, or continue migrating to reach the back electrode.

Figure 7:
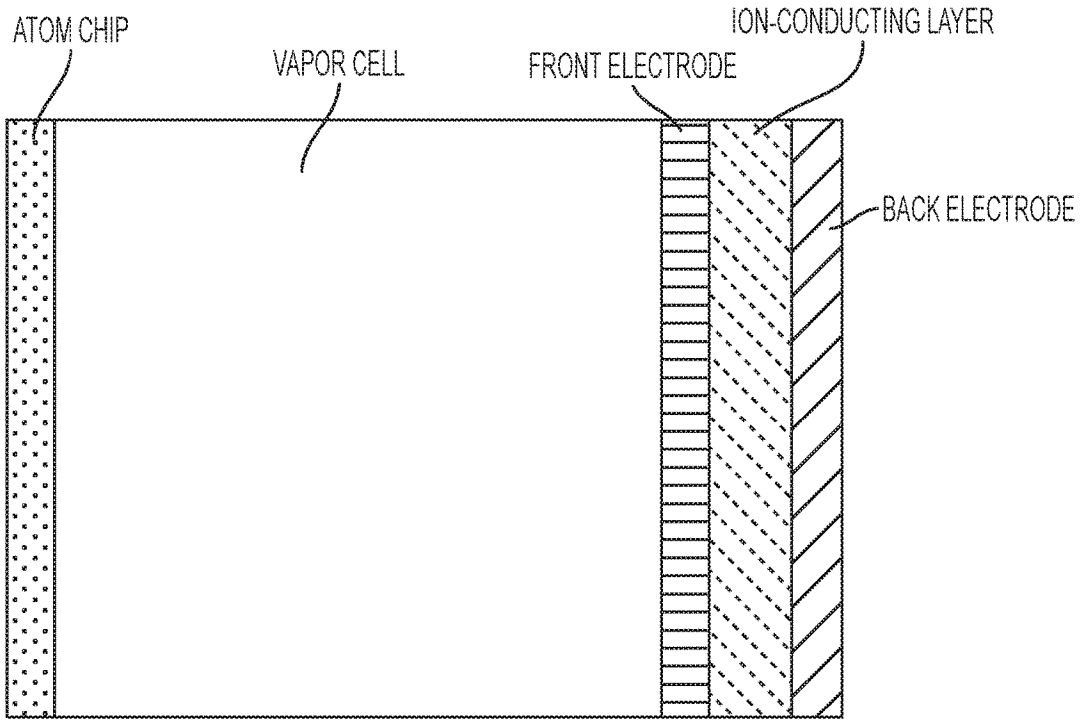
FIG. 7 is a schematic of an exemplary bidirectional solid-state charge-depletion capacitor alkali source/sink, packaged with an atom chip.

FIG. 7 is a schematic of an exemplary bidirectional solid-state charge-depletion capacitor alkali source/sink, packaged with an atom chip. A front electrode is disposed in communication with a vapor cell. An ion conductor is interposed between the front electrode and a back electrode. An atom chip is disposed within, or in communication with, the vapor cell.

Figure 8:
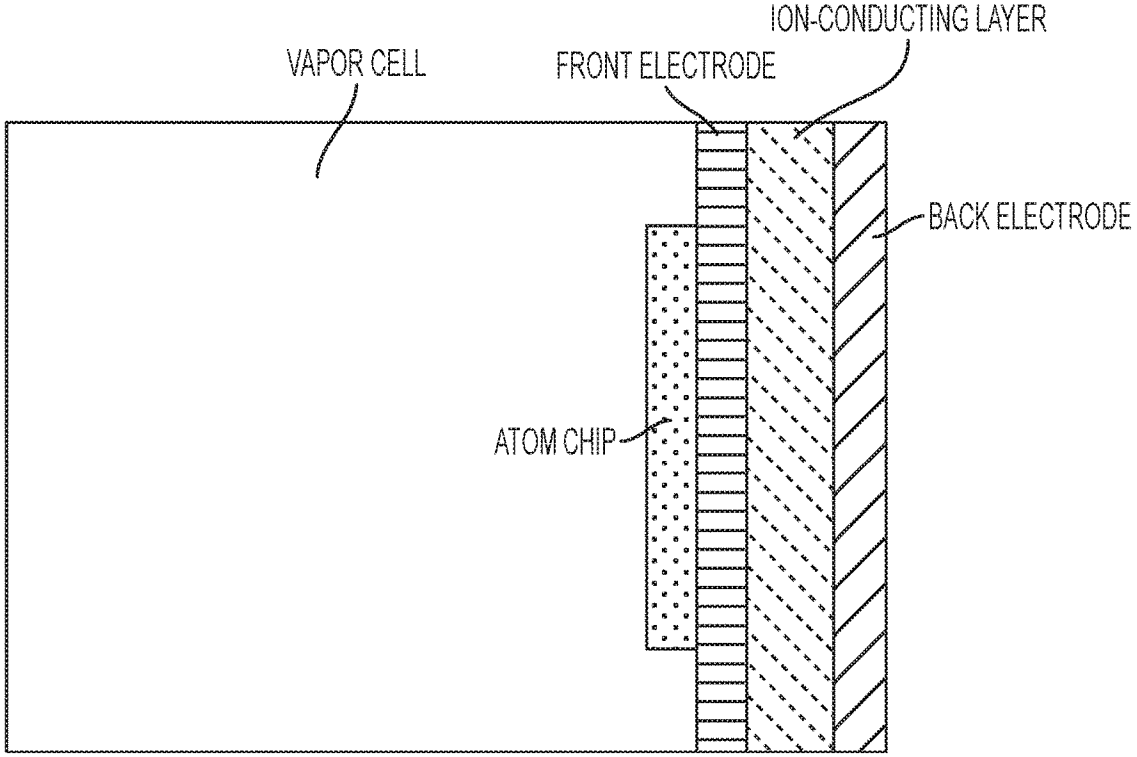
FIG. 8 is a schematic of an exemplary bidirectional solid-state charge-depletion capacitor alkali source/sink, heterogeneously integrated with an atom chip.

FIG. 8 is a schematic of an exemplary bidirectional solid-state charge-depletion capacitor alkali source/sink, heterogeneously integrated with an atom chip. A front electrode is disposed in communication with a vapor cell. An ion conductor is interposed between the front electrode and a back electrode. An atom chip is disposed within the vapor cell and further in physical contact with the front electrode, in this specific configuration.

Figure 9:
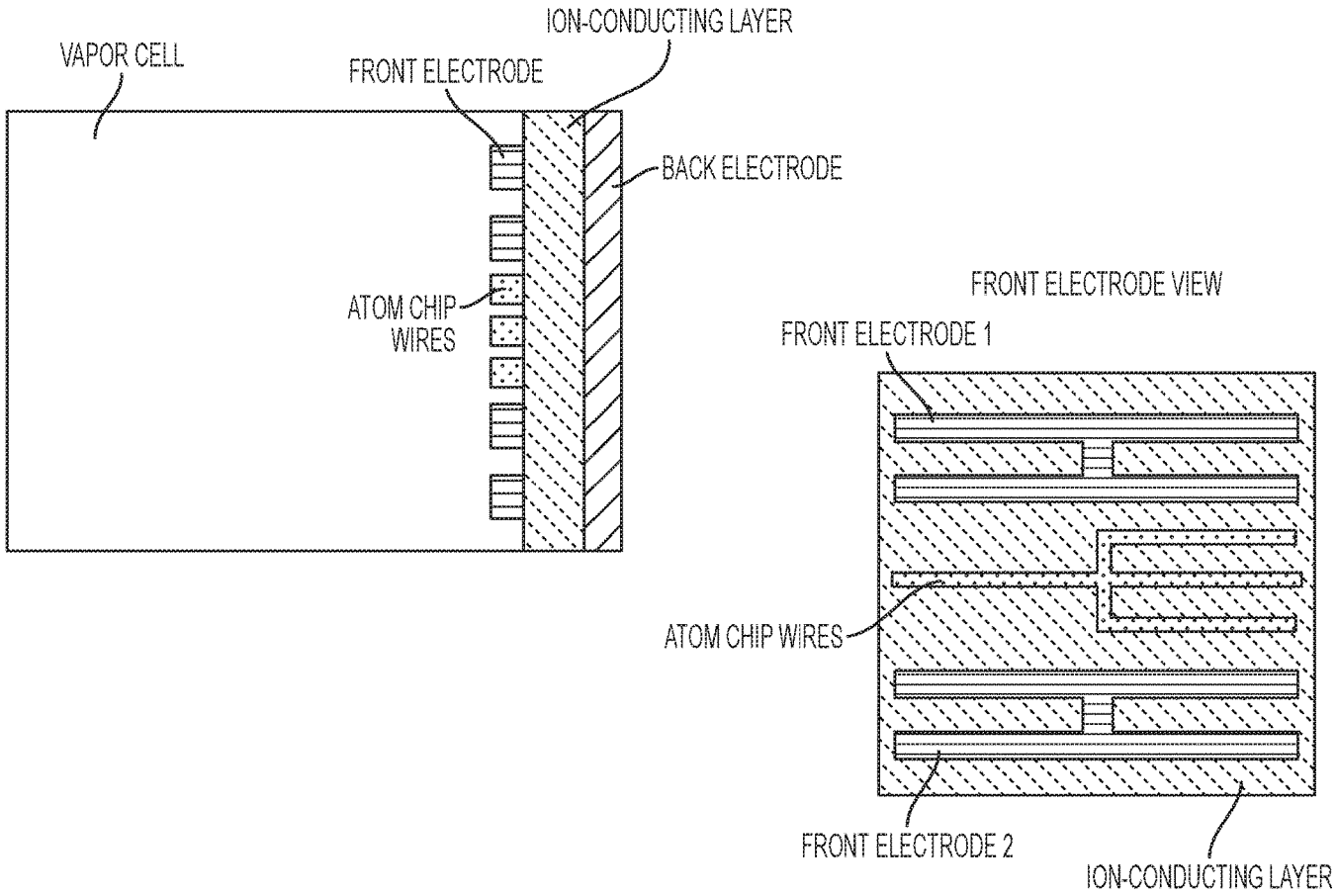
FIG. 9 is a schematic of an exemplary bidirectional solid-state charge-depletion capacitor alkali source/sink, fully integrated with an atom chip.

FIG. 9 is a schematic of an exemplary bidirectional solid-state charge-depletion capacitor alkali source/sink, fully integrated with an atom chip. A front electrode is disposed in communication with a vapor cell. An ion conductor is interposed between the front electrode and a back electrode. Atom chip wires are disposed within the vapor cell and further in physical contact with the ion conductor, similar to the disposition of the front electrode with the ion conductor, in this specific configuration. The front electrode view shows that the front electrode may be disposed as two (or more) physically separated electrodes (front electrode 1 and 2, in FIG. 9).

Some variations of the invention provide methods for operation of a vapor-cell system, including some or all of the following steps.

A voltage may be applied between the first (front) and second (back) electrodes. In some embodiments, the voltage is applied such the second electrode has a higher electrical potential than the first electrode. This causes mobile ions within the solid ion conductor to conduct towards the first electrode.

At or near a three-phase region of the first electrode, solid electrolyte, and vapor chamber volume, electrons will combine with mobile ions (e.g. $Rb^+$, $Cs^+$, $Na^+$, $K^+$, and/or $Sr^{2+}$) to create neutral atoms (e.g. Rb, Cs, Na, K, and/or Sr). These neutral atoms will then desorb from the surface into the vapor chamber volume, thus increasing the vapor density or vapor pressure in the vapor chamber volume.

Within the solid electrolyte near the second electrode, a region partially or fully depleted in mobile ions will form. Immobile ions (e.g., $—O^-$ or $—O^{2-}$) will remain. These immobile ions will form a charge-depletion capacitor balanced by the charge on the second electrode. These charges are physically separated. Alkali ion flow may be reduced and may eventually stop as more and more of the applied voltage drops across the charge-depletion capacitor region to maintain the charge separation.

Other variations of the invention provide a method of using a vapor-cell system in forward operation, the method comprising:

(a) providing a vapor-cell system with a vapor-cell region and an electrochemical charge-depletion capacitor, wherein the electrochemical charge-depletion capacitor comprises a first electrode disposed in contact with the vapor-cell region, a second electrode electrically isolated from the first electrode, and an ion conductor interposed between the first electrode and the second electrode, wherein the ion conductor is ionically conductive for mobile ions; and (b) pumping the mobile ions into the vapor-cell region in response to an electrical control signal applied to the first and second electrodes, wherein during step (b), immobile ions contained within the ion conductor are charge-balanced by a physically separated opposite charge on the second electrode, and wherein the mobile ions contained within the ion conductor migrate toward the first electrode and enter the vapor-cell region as neutral atoms.

Other variations of the invention provide a method of using a vapor-cell system in reverse operation, the method comprising:

(a) providing a vapor-cell system with a vapor-cell region and an electrochemical charge-depletion capacitor, wherein the electrochemical charge-depletion capacitor comprises a first electrode disposed in contact with the vapor-cell region, a second electrode electrically isolated from the first electrode, and an ion conductor interposed between the first electrode and the second electrode, wherein the ion conductor is ionically conductive for mobile ions; and (b) pumping neutral atoms out of the vapor-cell region in response to an electrical control signal applied to the first and second electrodes, wherein during step (b), immobile ions contained within the ion conductor are charge-balanced by a physically separated opposite charge on the second electrode, and wherein the neutral atoms migrate from the vapor-cell region to the first electrode and then migrate as the mobile ions through the ion conductor toward the second electrode.

In some embodiments of these methods, the vapor-cell region is configured to allow at least one vapor-cell optical path into a vapor-cell vapor phase within the vapor-cell region. Preferably, the vapor-cell system is configured to allow three vapor-cell optical paths into the vapor-cell vapor phase. The three vapor-cell optical paths may be geometrically orthogonal or pyramidal, for example.

A population of cold atoms (i.e., two or more cold atoms at temperatures of, for example, about 100 μK to 1000 μK) may be prepared within the vapor chamber volume. This population may be formed with a magneto-optical trap (MOT), as described above.

In some embodiments, a voltage is reduced between the first and second electrodes. The applied voltage may be reduced, brought to zero, or even reversed in polarity. This voltage reduction causes mobile ions within the solid ion conductor to conduct towards the ion-depleted region.

Where neutral atoms (e.g. Rb, Cs, Na, K, and/or Sr) from the vapor phase adsorb at or near the three-phase region of the first electrode, ion conductor, and vapor chamber volume, neutral atoms will separate into electrons and mobile ions (e.g. $Rb^+$, $Cs^+$, $Na^+$, $K^+$, and/or $Sr^{2+}$). This will reduce the vapor density or vapor pressure in the vapor chamber volume. The mobile ions near the first electrode will conduct into the ion conductor, towards the ion-depleted region.

After reducing the vapor pressure as described above, the trap on the population of cold atoms may be released and a measurement of frequency or position may be made, for example.

In this detailed description, reference has been made to multiple embodiments and to the accompanying drawings in which are shown by way of illustration specific exemplary embodiments of the invention. These embodiments are described in sufficient detail to enable those skilled in the art to practice the invention, and it is to be understood that modifications to the various disclosed embodiments may be made by a skilled artisan.

Where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially.

All publications, patents, and patent applications cited in this specification are herein incorporated by reference in their entirety as if each publication, patent, or patent application were specifically and individually put forth herein.

The embodiments, variations, and figures described above should provide an indication of the utility and versatility of the present invention. Other embodiments that do not provide all of the features and advantages set forth herein may also be utilized, without departing from the spirit and scope of the present invention. Such modifications and variations are considered to be within the scope of the invention defined by the claims.

What is claimed is:

1. A vapor-cell system comprising a bidirectional solid-state electrochemical charge-depletion capacitor and a vapor-cell region configured to allow at least one optical path into a vapor phase within said vapor-cell region, wherein said charge-depletion capacitor includes:

(i) a first electrode disposed in contact with said vapor-cell region;

(ii) a second electrode electrically isolated from said first electrode; and (iii) an ion conductor interposed between said first electrode and said second electrode, wherein said first electrode is permeable to mobile ions and/or neutral atoms formed from said mobile ions;

wherein said ion conductor is ionically conductive for said mobile ions, and wherein said second electrode does not contain a second-electrode material that is capable of forming said mobile ions.

2. The vapor-cell system of claim 1, wherein said charge-depletion capacitor stores electrical charge by reduction-oxidation reactions, electrosorption, intercalation, or combinations thereof.

3. The vapor-cell system of claim 1, wherein said charge-depletion capacitor has an actuation voltage of about 100 V or less.

4. The vapor-cell system of claim 3, wherein said charge-depletion capacitor has an actuation voltage of about 10 V or less.

5. The vapor-cell system of claim 1, wherein said vapor-cell system is characterized by a vapor-cell time constant for said mobile ions of less than 1 second.

6. The vapor-cell system of claim 5, wherein said vapor-cell time constant is about 100 milliseconds or less.

7. The vapor-cell system of claim 1, wherein said vapor-cell vapor phase contains an alkali metal, an alkaline earth metal, or a combination thereof.

8. The vapor-cell system of claim 1, wherein said vapor-cell vapor phase contains mercury, ytterbium, aluminum, cadmium, or a combination thereof.

9. The vapor-cell system of claim 1, wherein said ion conductor is ionically conductive for at least one ionic species selected from the group consisting of $Rb^+$, $Cs^+$, $Na^+$, $K^+$, and $Sr^{2+}$.

10. The vapor-cell system of claim 1, wherein said ion conductor is characterized by an ionic conductivity at 25° C. of about $10^{-7}$ S/cm or higher.

11. The vapor-cell system of claim 10, wherein said ion conductor is characterized by an ionic conductivity at 25° C. of about $10^{-5}$ S/cm or higher.

12. The vapor-cell system of claim 1, wherein said ion conductor contains said mobile ions.

13. The vapor-cell system of claim 1, wherein said ion conductor contains immobile ions having opposite charge of said mobile ions.

14. The vapor-cell system of claim 1, wherein said ion conductor comprises alumina, β-alumina, β"-alumina, yttria-stabilized zirconia, NASICON, LISICON, KSICON, or combinations thereof.

15. The vapor-cell system of claim 1, wherein said first electrode is fabricated from a metal selected from the group consisting of platinum, molybdenum, tungsten, and combinations thereof.

16. The vapor-cell system of claim 1, wherein said first electrode is in the form of a mesh, a grid, a porous material with open porosity, a parallel line pattern, a microwire array, a nanowire array, a lithographically patterned network, or a combination thereof.

17. The vapor-cell system of claim 1, wherein said second electrode is not in contact with said vapor-cell region.

18. The vapor-cell system of claim 1, wherein said second electrode is not permeable to said mobile ions or neutral atoms formed from said mobile ions.

19. The vapor-cell system of claim 1, wherein said second-electrode material is not capable of forming second-electrode ions, different than said mobile ions, which are mobile in said ion conductor.

20. The vapor-cell system of claim 1, wherein said second electrode is fabricated from a metal selected from the group consisting of platinum, molybdenum, tungsten, and combinations thereof.

21. The vapor-cell system of claim 1, said system further comprising an atom chip contained within said vapor-cell region.

22. The vapor-cell system of claim 1, wherein said vapor-cell system is configured to allow three optical paths into said vapor phase.

23. A magneto-optical trap apparatus, said apparatus comprising:

(a) a bidirectional solid-state electrochemical charge-depletion capacitor;

(b) a vapor-cell region configured to allow three orthogonal optical paths into a vapor phase within said vapor-cell region;

(c) a source of laser beams configured to provide said three orthogonal vapor-cell optical paths through said vapor-cell gas phase, to trap a population of cold atoms; and (d) a magnetic-field source configured to generate magnetic fields within said vapor-cell region, wherein said charge-depletion capacitor includes:

(i) a first electrode disposed in contact with said vapor-cell region;

(ii) a second electrode electrically isolated from said first electrode; and (iii) an ion conductor interposed between said first electrode and said second electrode, wherein said first electrode is permeable to mobile ions and/or neutral atoms formed from said mobile ions;

wherein said ion conductor is ionically conductive for said mobile ions, and wherein said second electrode does not contain a second-electrode material that is capable of forming said mobile ions.

24. An atomic-cloud imaging apparatus, said apparatus comprising:

(a) a bidirectional solid-state electrochemical charge-depletion capacitor;

(b) a vapor-cell region configured to allow three orthogonal optical paths into a vapor phase within said vapor-cell region;

(c) a source of laser beams configured to provide said three orthogonal vapor-cell optical paths through said vapor-cell gas phase, to image a population of cold atoms; and (d) a magnetic-field source configured to generate magnetic fields within said vapor-cell region, wherein said charge-depletion capacitor includes:

(i) a first electrode disposed in contact with said vapor-cell region;

(ii) a second electrode electrically isolated from said first electrode; and (iii) an ion conductor interposed between said first electrode and said second electrode, wherein said first electrode is permeable to mobile ions and/or neutral atoms formed from said mobile ions;

wherein said ion conductor is ionically conductive for said mobile ions, and wherein said second electrode does not contain a second-electrode material that is capable of forming said mobile ions.

* * * * *